US006491096B1

(12) United States Patent
Masek

(10) Patent No.: US 6,491,096 B1
(45) Date of Patent: Dec. 10, 2002

(54) TWO PHASE HEAT GENERATION SYSTEM AND METHOD

(76) Inventor: John A. Masek, P.O. Box 15178, Zapata, TX (US) 78076

( * ) Notice: Subject to any disclaimer, the term of this patent is extended or adjusted under 35 U.S.C. 154(b) by 0 days.

(21) Appl. No.: 09/763,472

(22) Filed: Apr. 24, 2001

Related U.S. Application Data

(63) Continuation of application No. 09/139,304, filed on Aug. 25, 1998, now Pat. No. 6,044,907.

(51) Int. Cl.[7] ..... E21B 43/16

(52) U.S. Cl. ..... 166/275; 166/58; 166/59; 166/303; 299/2

(58) Field of Search ..... 166/302, 303, 166/260, 275, 58, 59; 299/2

(56) References Cited

U.S. PATENT DOCUMENTS 3,595,316 A 7/1971 Myrick, III
4,159,743 A 7/1979 Rose et al.
4,597,441 A * 7/1986 Ware et al.
4,611,855 A 9/1986 Richards
4,865,130 A 9/1989 Ware et al.
5,217,076 A 6/1993 Masek
5,488,990 A 2/1996 Wadleigh et al.

* cited by examiner

*Primary Examiner*—Roger Schoeppel
(74) *Attorney, Agent, or Firm*—Harness, Dickey & Pierce, P.L.C.

(57) ABSTRACT

The present invention provides a two phase heat generation system (10) having a primary pressure vessel (108), an, interior vessel (122) spaced from the primary pressure vessel (108) defining a water jacket cavity (124) and a combustion chamber (125), the water cavity (124) being in fluid communication with the combustion chamber (126), the combustion chamber (126) having a combustion burner (144) for controlling combustion, a delivery conduit (136) being in communication with the combustion chamber (126) for delivering gas and compressed air into the combustion chamber (126) and an outlet passage (164) being in communication with the combustion chamber (126) for delivering of a two phase product.

32 Claims, 4 Drawing Sheets

Δ = THE PRESSURE NEEDED TO MOVE FLUIDS THRU THE OIL RESERVOIR.
× = THE PRESSURE NEEDED TO MOVE FLUIDS THRU THE PRODUCING BORE.

× + Δ = PRESSURE AT THE OUTLET OF THE INJECTION BORE

TWO PHASE HEAT GENERATION SYSTEM AND METHOD

This is a national stage application of PCT/US99/19341 filed Aug. 24, 1999 which is a continuation of U.S. application Ser. No. 09/139,304 field Aug. 25,1998, now U.S. Pat. No. 6,044,907.

BACKGROUND OF THE INVENTION

1. Technical Field

The present invention relates generally to heat generation systems, and more particularly to a two phase heat generation system.

2. Discussion

Under conventional technology, heat generation systems include multiple types of equipment ranging from a simple space heater to an industrial boiler. These various types are powered by a variety of energy sources. Examples range from coal generated electrical current powering a heating element of a space heater to the combustion of natural gas in a conventional boiler. For each type of equipment, a single phase product is delivered as the end product of the consumption of energy for the intended end use. For example, the combustion of natural gas in a gas forced air furnace produces combustion gases (heat) for the end use. Conversely, the combustion of natural gas might alternatively ultimately produce steam for the end use. In either scenario and under conventional methods, the simultaneous delivery to the end use of two phases of product from one source is unique.

In conventional boiler technology where natural gas is used as the source of energy, the limitation of delivering a single phase product to the end use is further limited by the fact that heat, the primary energy from the combustion of natural gas is lost to the environment rather than serving the purpose for the end use. This limitation results in significantly reduced efficiency and accompanying expense. Additionally, the limitation of 1) single phase product and 2) loss of energy to the environment is compounded by the necessity of constructing comparably larger heat generation systems to compensate for these limitations in order that sufficient energy is delivered to the end use. These detriments are further compounded when the end use requires a two phase product rather than the traditional single phase product of the conventional technology. In such instances, as for example in U.S. Pat. No. 5,217,076, the ability to efficiently perform the end use, i.e., for U.S. Pat. No. 5,217,076, to facilitate the recovery of oil from subsurface deposits is diminished.

When the end use is as reflected in U.S. Pat. No. 5,217,076, under conventional methods delivering product uniformly and efficiently into deep formations has proven to be less than successful. This is in part due to the above referenced detriments associated with conventional heat generation systems and in part due to limitations in the injection/field assemblies that are used with the conventional technology to deliver product into a geological formation. Efforts at resolving the detriments in delivering product efficiently and effectively have also proven less than successful.

It is therefore desirable to provide a two phase heat generation system which has comparably inexpensive construction costs, operating costs, an efficiency approaching 90 to 100%, two phase product from one source and for oil recovery end uses an improved system of delivery.

SUMMARY OF THE INVENTION

Accordingly, it is an object to the present invention to provide a two phase heat generation system having a primary pressure vessel, at least one interior vessel contained within the primary pressure vessel defining a combustion chamber, at least one interior vessel contained within the primary pressure vessel defining a water cavity, the water cavity being in fluid communication with the combustion chamber, a combustion burner contained within the combustion chamber for controlling combustion, at least one port in communication with the combustion chamber for delivering gas and compressed air and at least one outlet in communication with the combustion chamber for delivering a two phase product from the combustion chamber.

It is a further object of the present invention to provide a two phase heat generation system that simultaneously delivers super heated steam and non-condensable inert gases at various pressures and temperatures.

It is a further object of the present invention to provide a two phase heat generation system that is 90 to 100% efficient.

It is a further object of the present invention to provide a two phase heat generation system that delivers significantly more BTUs/day than conventional comparable methods.

It is a further object of the present invention to provide a two phase heat generation system that is comparably less expensive to construct and operate.

It is a further object of the present invention to provide a two phase heat generation system that provides an injection/field assembly for delivering two phase product.

It is a further object of the present invention to provide a two phase heat generation system that provides injection of formation friendly water.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict a preferred embodiment of the present invention and are not therefore to be considered limiting in scope, the invention will be described and explained with additional specificity and detail through the use of the accompanying drawings in which.

DETAILED DESCRIPTION OF THE PREFERRED EMBODIMENTS

Figure 1:
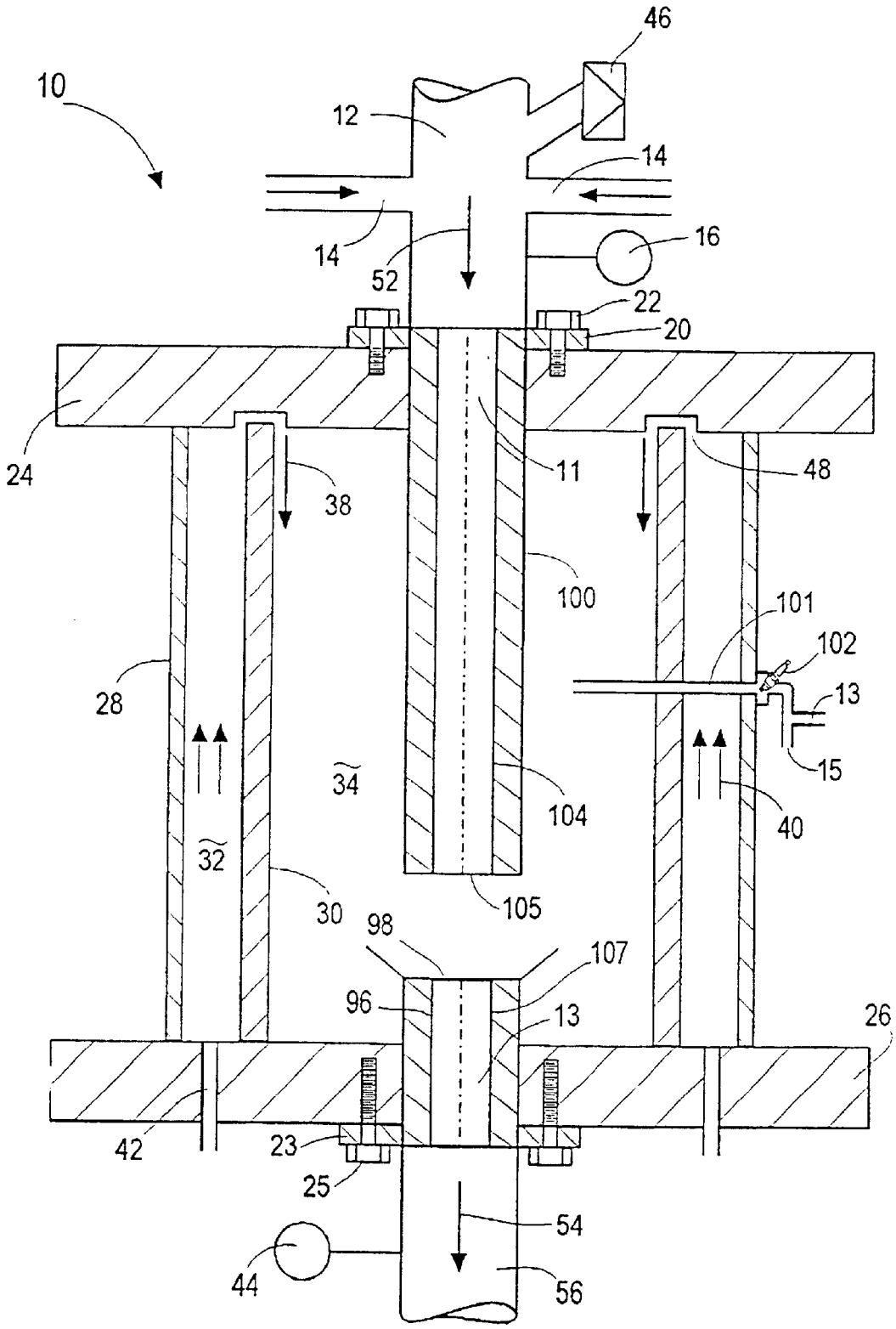
FIG. 1 is a partial cross-sectional view of the two phase heat generation system.
Figure 3:
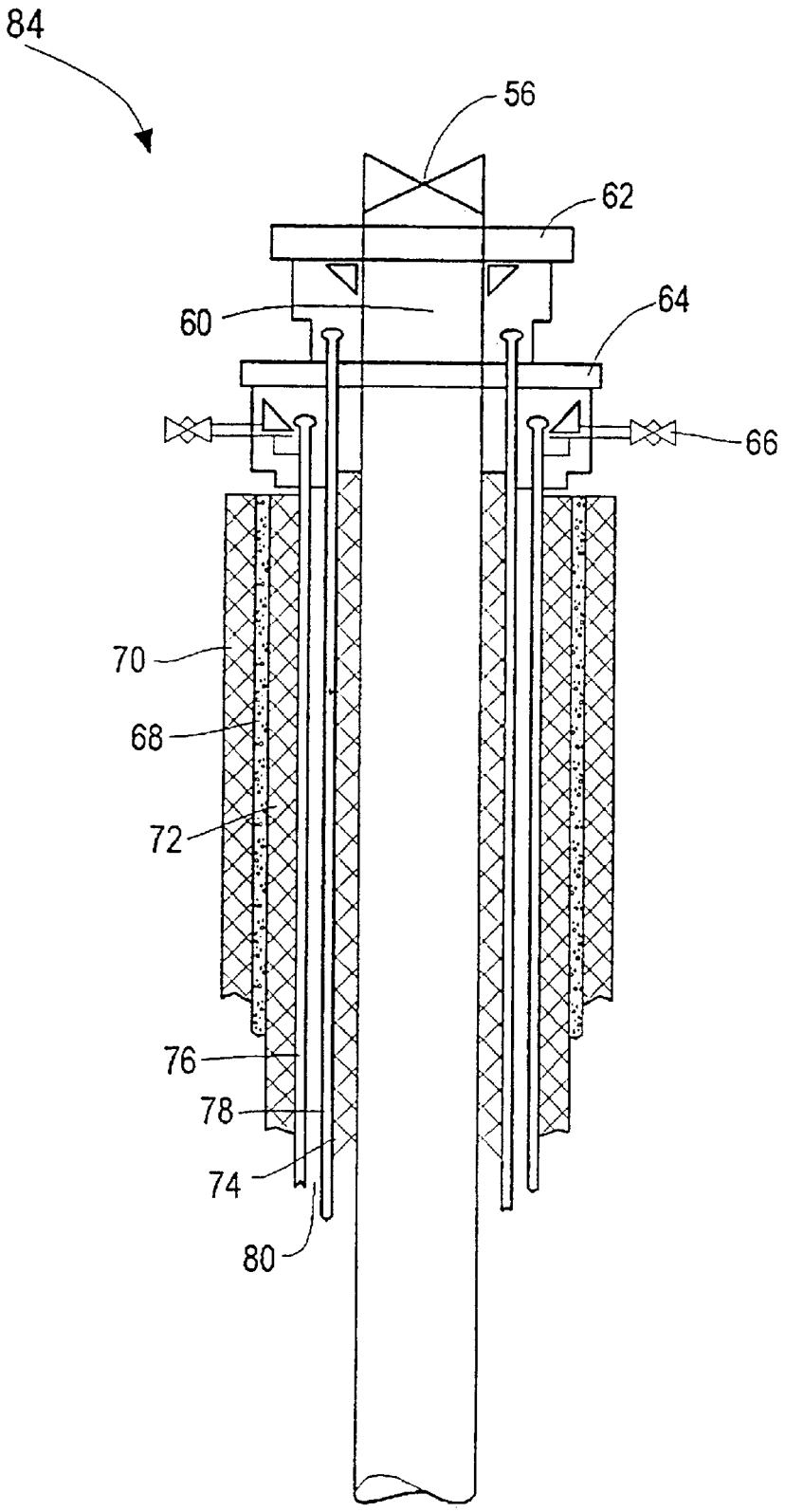
FIG. 3 is a partial cross-sectional view of an injection assembly for use with the system of FIG. 1 or FIG. 2.
Figure 4:
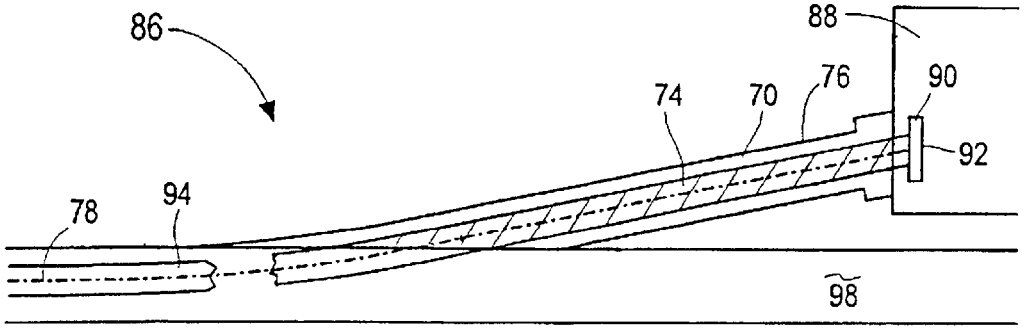
FIG. 4 is a partial cross-sectional view of a field assembly.

The present invention is directed towards a two phase heat generation system 10 as illustrated in FIG. 1. The two phase heat generation system 10 has multiple applications depending on the intended end use. For purposes of description of the illustrated embodiments, the two phase heat generation system 10 will be detailed for use as a generation plant for providing super heated steam at multiple desired temperatures and pressures, and simultaneously providing non-condensable inert gas at multiple desired temperatures and pressures for the recovery of oil from porous subsurface deposits as disclosed in U.S. Pat. No. 5,217,076, which is herein incorporated by reference. Additionally, the two phase heat generation system 10 will be described with the present invention of a field assembly 86 as illustrated in FIG. 4 and an injection assembly 84 as illustrated in FIG. 3, in light of U.S. Pat. No. 5,217,076 as incorporated by reference. The present invention as is hereinafter detailed in light of U.S. Pat. No. 5,217,076 should not be interpreted as limiting the breadth of potential uses of the present invention in other commercial fields of endeavor or for other intended end uses, nor should it be interpreted in limiting independent or conjoined use of the two phase generation system and the injection/field assembly.

The two phase heat generation system 10 is preferably constructed in accordance with ASTM boiler code standards for pressure vessels. The ASTM boiler code dictates minimum tolerances, thicknesses, and metallurgies required for constructing such heat generation systems. Additionally, the overall length and diameter of the two phase heat generation system 10 depends upon the type of end use envisioned by the operator, the design features more particularly being dictated by ASTM boiler code based on (a) the pressure required from 10#/in$^2$ to 2500#/in$^2$, (b) the volume of heat being delivered (range 10 million BTUs/day to 1 billion BTUs/day) and (c) the temperature of the product to be delivered (212° to 1500° F.). As such, the description below of the two phase heat generation system 10 is dependent upon the ASTM boiler code standards as referenced above.

In accordance with the illustrated embodiment of FIG. 1, the two phase heat generation system 10 has a primary pressure vessel 28. The primary pressure vessel 28 is fixably connected at one end to an upper plate 24 and at the opposite end to a lower plate 26. The primary pressure vessel 28, the upper plate 24 and the lower plate 26 in a general way define the exterior parameters of the two phase heat generation system 10. It should be understood at this point that the two phase heat generation system 10 of the illustrated embodiment of FIG. 1 is substantially cylindrical and as such, the cross-sectional view in FIG. 1 as illustrated has for the most part equivalent elements on each side.

Returning to FIG. 1, upper plate 24 of the heat generation system 10 has an annular channel 48. The annular channel 48 accepts an interior vessel 30. The interior vessel 30 is fixably connected at one end to the lower plate 26 and, at its opposite end, is accepted within the annular channel 48. The interior vessel 30 is spaced from the primary pressure vessel 28, therein defining a water jacket cavity 32 formed between the interior vessel 30 and the primary vessel 28. The interior vessel 30 further defines a combustion chamber 34 between its inner walls. The upper plate 24 has an inlet passage 11 which is substantially centered within annular channel 48 and is at one end in communication with a compressed air port 12. The compressed air port 12 is fixably connected to the upper plate 24 by a mounting plate 20 and mounting bolts 22. The compressed air port 12 is also in communication with a gas supply port 14 and a rupture disc 46. The compressed air port 12 is also in communication with a pressure gauge 16, at a point between the gas supply port 14 and the upper plate 24. At the end opposite to the compressed air port 12, the inlet passage 11 is in communication with a combustion burner 100. The combustion burner 100 is substantially cylindrical and slidably fits within the inlet passage 11. The combustion burner 100 has a flange (not shown) at its end which is used to mount the combustion burner 100 to the upper plate 24 by way of the mounting plate 22 and the mounting bolts 20. The combustion burner 100 extends into the combustion chamber 34. The combustion burner 100 has multiple slit-like perforations 104 that allow communication between the interior of the combustion burner 100 and the combustion chamber 34. The combustion burner 100 has at its end a cap 105. The combustion burner 100 and the cap 105 are constructed of inconel or a similar heat resistant material. It should be understood that the combustion burner 100 may be constructed in differing configurations and that the slot-like perforations 104 may have various configurations and designs.

Returning to FIG. 1, the lower plate 26 of the heat generation system 10 has a water supply port 42 which is in communication with the water jacket cavity 32. The water jacket cavity 32 is in communication with the annular cavity 48 which is in turn in communication with the combustion chamber 34. The lower plate 26 has an outlet passage 13 which is substantially centered in the lower plate 26 and in communication at one end with an injection port 56 and at the other end with combustion chamber 34. The injection port 56 is fixably connected to the lower plate 26 by a mounting plate 23 and bolts 25. The injection port 56 is in communication with a temperature gauge 44 and a temperature transmitter (not shown). The outlet passage 13 at the end opposite to the injection port 56 is in communication with a flame arrestor 96 that slidably fits within the outlet passage 13. The flame arrestor 96 has a flange (not shown) at its end which is used to mount the flame arrestor 96 to the lower plate 26 by way of the mounting plate 23 and the mounting bolts 25. The flame arrestor 96 extends into the combustion chamber 34. The flame arrestor 96 has multiple slit-like perforations 107 that allow communication between the interior of the flame arrestor 96 and the combustion chamber 34. The flame arrestor 96 has at its end a cap 98 that is concave in design. The flame arrestor 96 and the cap 98 are constructed of inconel or a similar heat resistant material. It should be understood that the multiple slit-like perforations 107 may have various configurations and designs. It should also be understood that use of the flame arrestor 96 is optional.

Returning to FIG. 1, at a point between the upper plate 24 and the lower plate 26 the primary vessel 28 has mounted to its exterior wall a pilot burner 101. The pilot burner 101 passes through the primary vessel 28, the water jacket 32 and the interior vessel 30, extending into the combustion chamber 34. The pilot burner 101 at its end exterior to the primary vessel 28 is connected to a compressed air port 13 and a natural gas port 15 which are in communication with the combustion chamber 34 by way of the pilot burner 101. The pilot burner 101 has a spark plug 102.

It should be appreciated that the injection port 56 may be constructed of a number of materials including stainless steel and may have a number of forms including being braided. It should also be appreciated that the injection port 56 may have a valve (not shown) incorporated therein. It should also be appreciated that the two phase heat generation system 10 and its components may be constructed of a number of materials including ceramic, stainless steel and inconel.

Figure 2:
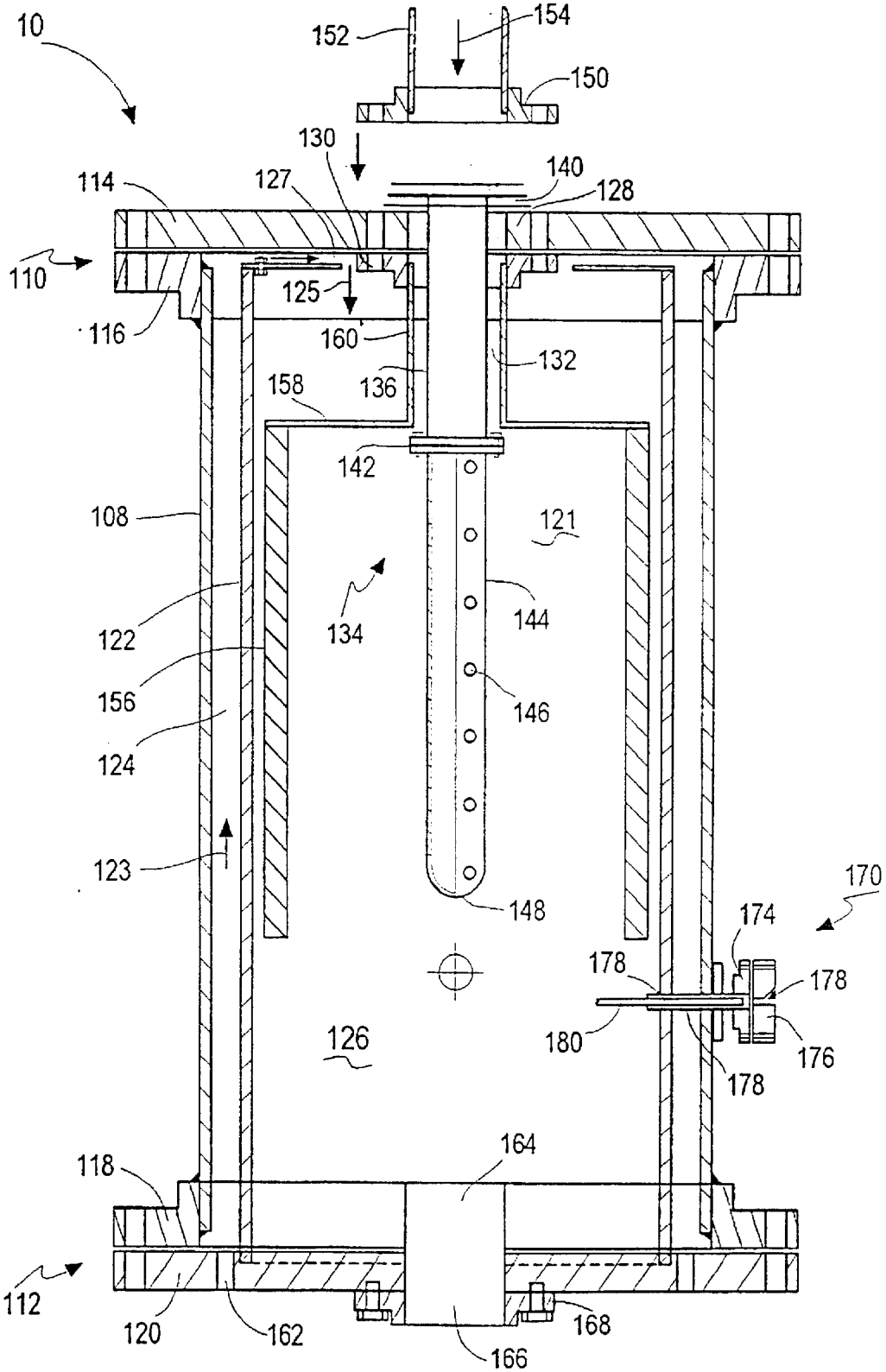
FIG. 2 is a partial cross-sectional view of an alternate embodiment of the two phase heat generation system.

Turning now to FIG. 2, an alternate embodiment of the heat generation system 10 is shown. It should be understood that the heat generation system 10' is identical in many respects to the heat generation system 10 in terms of components, construction, materials and use. In accordance with the illustrated alternate embodiment of FIG. 2, the heat generation system 10' has a primary vessel 108 that is fixedly connected at its one end to an upper plate portion 110 and at its opposite end to a lower plate portion 112. The primary vessel 108, the upper plate portion 110 and the lower plate portion 112 in a general way define the exterior parameters of the two phase heat generation system 10'. It should be understood that the two phase heat generation system 10' of the illustrated embodiment of FIG. 2 is substantially cylindrical and as such, the cross-sectional view of FIG. 2 as illustrated has for the most part equivalent elements on each side.

Returning to FIG. 2 of the heat generation system 10', the upper plate portion 110 includes an inner upper plate 114 and an outer upper plate 116. The lower plate portion 112 includes an inner lower plate 118 and an outer lower plate 120. The primary pressure vessel 108 is fixably connected at its one end to the inner upper plate 116 and at its opposite end to the inner lower plate 118. Interior to the primary pressure vessel 108 and spaced therefrom is an interior vessel 122. The interior vessel 122 is fixably connected at its one end to the inner lower plate 118 and at its opposite end it is free floating within the inner upper plate 116. The interior vessel 122 and the primary pressure vessel 108 define a water jacket cavity 124 formed between the interior vessel 122 and the primary pressure vessel 108. The interior vessel 122 further defines a combustion chamber 126 between its inner walls. The combustion chamber 126 and the water jacket cavity 124 are in fluid communication via a passageway 127 formed by the inner vessel 122 being free floating within the inner upper plate 116.

Returning to FIG. 2, the outer upper plate 114 has a hanger flange 128 that is centrally located in the outer upper plate 114. The inner upper plate 116 has an inner flange 130 that is centrally located in the upper plate 116. The inner flange 130 is adapted to mate with the hanger flange 128 when the outer upper plate 114 is mounted to the inner upper plate 116. The hanger flange 128 and the inner flange 130 upon mating define a passage 132. The passage 132 is adapted to accept a combustion burner system 134. The combustion burner system 134 includes a delivery conduit 136 and a combustion burner 144 (shown partially cross-sectioned in FIG. 2), the delivery conduit 136 having at its one end a hanger 140 that is designed to mate with the hanger flange 128 of the upper plate 114, and at its opposite end a combustion burner flange 142 that is designed to mount the delivery conduit 136 to the combustion burner 144. The combustion burner 144 has multiple slit-like perforations 146 that allow communication between the combustion chamber 126 and the combustion burner 144. The combustion burner 144 has at its end opposite to where it is mounted to the delivery conduit 136 an end cap 148.

Returning to FIG. 2, the combustion burner system 134 when received by the inlet passage 132 hangs centrally within the combustion chamber 126. The combustion burner system 134 is held into place via a sleeve plate 150 that is connected to an air/gas port 152 and mounted via sleeve plate 150 to hanger flange 128. It should be understood that air/gas port 152 provides an air/gas mixture 154 that is supplied via the same system as air/gas mixture 52 as illustrated in FIG. 1. Returning to FIG. 2, the combustion burner system 134 is encircled by a sleeve 156. The sleeve 156 is contained within the combustion chamber 126 and spaced from the internal vessel 122. The sleeve 156 is fixably mounted to the inner flange 130 via a base 158 that has a connecting sleeve 160. The sleeve 156 hangs substantially between the inner vessel 122 and the combustion burning system 134, therein forming a sub-combustion chamber 121. The sub-combustion chamber 121 is in fluid communication with the combustion chamber 126.

Returning to FIG. 2, the inner lower plate 118 and the outer lower plate 120 have water supply ports 162. When inner lower plate 118 is mounted to outer lower plate 120 the supply ports 162 are in fluid communication with the water jacket cavity 124. The inner lower plate 118 and the outer lower plate 120 when mounted together define an outlet passage 164. The outlet passage 164 at one end is in communication with the combustion chamber 126 and at its opposite end is in communication with an injection port 166. The injection port 166 is mounted to the outer lower plate 120 via mounting plate 168. The injection port 166 and all of the elements that are part of the port are as reflected in FIG. 1 and as previously described.

Returning to FIG. 2, at a point between the upper plate portion 110 and the lower plate portion 112, and at a point below the sleeve 156 is mounted to the primary vessel 108 a pilot burner 170. The pilot burner 170 passes through the primary vessel 108, the water jacket 124 and the interior vessel 122 via a sleeve housing 172 and into the combustion chamber 126. The pilot burner 170 at its end exterior to the primary vessel 108 has an interior flange 174 mounted to an exterior flange 176. The exterior flange 176 is adapted via spark plug cavity 178 to accept a spark plug (not shown). The pilot burner 170 has a cavity 178 adapted to receive a burner 180. The burner 180 passes through the length of the pilot burner 170 and into the combustion chamber 126.

Turning now to FIG. 3, an injection assembly 84 of the illustrated embodiment is shown. The injection assembly 84 is in communication with the heat generation system via the injection port of FIG. 1 or FIG. 2. The injection port is coupled and contained within an inner well head assembly 62. The inner well head assembly 62 is coupled to an outer-well head assembly 64. It shall be understood that the inner well head assembly 62 and the outer well head assembly 64 are known in the art. An injection pipe 60 is at one end in communication with the injection port. The injection pipe 60 passes through the interior of the inner well head assembly 62. An insulation 74 is in substantial contact with the injection tubing 60. The outer well head assembly 64 is contained within a conductor pipe 76. A well tubing 78 is contained within the outer well head 64, exterior to the insulation 74 and interior to the conductor pipe 76 and in communication with the injection tubing 60. An annular space 80 is formed between the well tubing 78 and the conductor pipe 76. The annular space 80 is in communication with the outer well head assembly 64 and in communication with annular valves 66. A conductor casing 76 is connected to the outer well head 64 and cemented its full length with a silica/cement 72. A collar pipe 68 is cemented in place with a neat cement 70. The silica/cement 72 runs the full length of the conductor pipe 76. The well tubing 78 runs the full length of the conductor pipe 76 and a horizontal bore.

Turning more particularly to FIG. 3 and FIG. 4, a field assembly 86 of the illustrated embodiment is shown. A room 88 is mined to within several feet of a formation 98. A bore is drilled at an angle of 4° to 10° downward from the room 88 into the formation 98. Thereafter, the injection assembly 84 is constructed by drilling an initial large diameter collar (preferably 18") at an angle of 1° to 10° for 15' to 30'. The bore is then cased with a large diameter collar pipe 68 (preferably 13") and cemented with neat cement. A drilling diverter head is installed on the collar pipe 68 through which a conductor casing bore is drilled (preferably 12¾"). The conductor casing (preferably 8") is set and centralized in the bore and cemented with a mixture of preferably 30% silica/cement. A second diverter head is attached to the conductor pipe 76 through which production/ injection bores are drilled to 2000' to 5000' depending on reservoir conditions. Drilling production/ injection bores is accomplished using conventional horizontal drilling technology. The well tubing 78 which extends the full length of the bore (preferably 7") can be any size, but is controlled by the amount of two phase product to be injected. The bore is left uncased and the well tubing 78 is open ended. The well tubing 78 (preferably 4½") is held and sealed by the outer well head assembly 64. A small (preferably 2") injection tube is installed inside the well tubing 78 for a length equaling the distance from the room to the top of the oil zone. This 2" injection tube is insulated to prevent heat from escaping into the overburden above the oil zone. This 2" injection tube is held and sealed by the inner well head assembly 62 which is attached to the well tubing 78.

Two phase product is delivered from the combustion chamber through the injection port and into the injection tube 60. Two phase product travels the full length of the injection tube 60 and is delivered into the well tubing 78. The two phase product then travels the length of the well tubing 78 and exits the well tubing 78, and is ratably delivered to the oil bearing zone as illustrated in FIG. 4. The field assembly 86 will be in communication with the bore holes and grid as shown in U.S. Pat. No. 5,217,076, as incorporated by reference herein. It will be understood that the injection bore and production bore as referenced in U.S. Pat. No. 5,217,076 are identical in construction as referenced herein, with the exception that the injection bore is connected to the two phase heat generation system 10. It will further be understood that various diameters and sizings referenced herein may change as dictated by the requirements of the end use.

Figure 5:
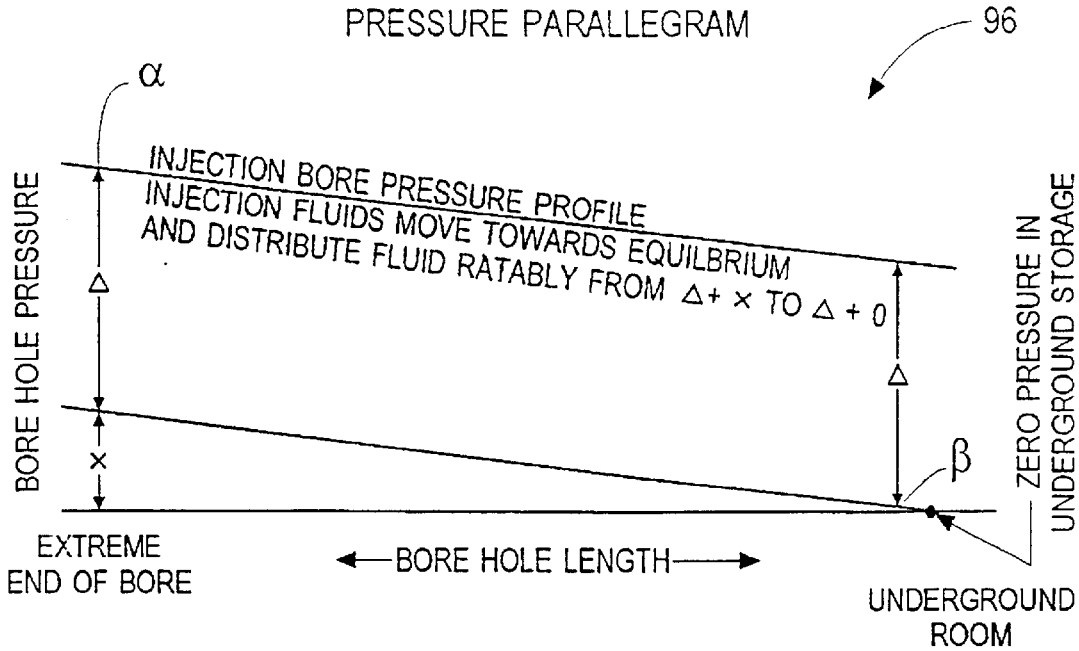
FIG. 5 is an illustration of an injection bore/production bore pressure diagram.

Turning to FIG. 5, a pressure diagram is illustrated. The injection bore/production bore pressure diagram reflects the pressure gradient exhibited in the formation 98 of FIG. 4 following the method of operation of the two phase heat generation system 10. FIG. 5 reflects that Δ is equal to the-minimum amount of pressure needed to mobilize fluids through the formation. X is the pressure needed to move fluids through the production bore. The injection point is reflected as a at the extreme tip of the injection bore/string tubing, and the extraction point is reflected as β, the point at the end of the producing bore. The pressure gradient traveling along the formation is at its maximum pressure at point a and at its minimum pressure at point β, the pressure moving towards equilibrium distributing fluid ratably through the formation from Δ plus X to Δ plus 0.

Turning to the method of operation, for ease of description, the heat generation system 10' of the alternate embodiment illustrated in FIG. 2 will be described. It should be understood that the description is equally applicable to the heat generation system 10. Following preparation of the field as referenced in U.S. Pat. No. 5,217,076, encasement of the injection assembly 84 as illustrated in the field assembly 86, connection of the two phase heat generation system 10' to the injection assembly 84 in the room 88, and connection of the two phase heat generation system 10' to a compressed air source (not shown) and a natural gas source (not shown), the method of operation is described.

In the method of operation, three separate Honeywell control systems (not shown) are used to control the compressed air volume, the natural gas volume and the water volume. It should be understood that a variety of other control methods could be employed. In addition there are 1) regulators on the air, gas and water sources (not shown) which control the pressure delivered to the two phase heat generation system, and 2) control valves (not shown) which control the volume of air, gas and water delivered. The heat generation system 10' is manually fired by first releasing compressed air and natural gas into the pilot burner 170. The spark plug is sparked igniting the air/gas mixture. The water jacket cavity 124 is then filled and the water controller being put into the manual mode. The air controller is put on manual to approximately 10%. The gas controller is put on manual and opened until the gas volume equals approximately 1/10 of the air volume, the air/gas ratio for natural gas. The combustion burner system 134 may require back pressure in order to mix gas and compressed air. After ignition in the combustion burner 144 water is manually ramped up to maintain a desired temperature and put on automatic. The compressed air and gas valves are gradually opened to the desired injection pressure and placed on automatic to maintain an air/gas mixture (approximately 1/10) (10 air to 1 gas) as appropriate. The heat generation system 10' is manually started by releasing compressed air into the compressed air port 12 and natural gas into the gas supply port 14. Compressed air and natural gas commingle in the compressed air port 12 as they flow along a flow path 154 through the combustion burner system 134 and into the combustion burner 144. As commingled natural gas and compressed air flow through the combustion burner system 134 and into the combustion burner 144, the air/gas mixture is ignited by the pilot burner 170.

As combustion occurs the temperature and pressure in the combustion chamber 126 dramatically increase. Compressed air and natural gas continue to flow along the flow path 154 and increase in rate via feedback to the Honeywell control resulting in continuous combustion in the combustion burner 144. The products of combustion are expelled through the outlet passage 164 along a flow path 54 through the inlet port 56 and into the injection pipe 60. Once the temperature reaches a preset level, the temperature sensor 44 communicates with a Honeywell control to begin supplying water through the water supply port 162 into the water jacket cavity 124 along a flow path 123. Water flowing along the flow path 123 travels into the combustion chamber 126 along a flow path 125. Water entering the combustion chamber 126 causes a dramatic decrease in temperature and pressure in the combustion chamber 126 as the water vaporizes into super heated steam. The pressure sensor 16 and the temperature sensor 44 communicate with their respective Honeywell control units resulting in increased volumes of compressed air being pumped into the compressed air port 12 via the flow path 154. The natural gas flow slaves off the compressed air flow along the flow path 54 resulting in increased volume into the combustion chamber 126. The volume of water is commensurately increased via feedback from the temperature sensor 44 through the Honeywell control in order to cool the chamber. This cycle continues until the volume of compressed air, natural gas and water flow reaches a set point consistent with the preset readings on the Honeywell controls.

The two-phase product, i.e., super heated steam and non-condensable inert gases (nitrogen/carbon dioxide and trace elements) flow along the flow path 54 into the injection pipe 60. The two phase product flowing through the injection pipe 60 enters the well tubing 78 in the uncased bore positioned in the horizontal bore in the formation 98. As the two-phase product flows through the well tubing 78 through the length of the horizontal bore, energy in the form of heat is released to the formation. As the two-phase product reaches the end of the well tubing 78, the two phase product is released in the horizontal bore and begins to flow back along the exterior of the well tubing 78 towards the outer well head assembly 64. As the two phase product flows in picks up energy in the form of heat that radiates from the well tubing 78. This process creates a heat sink in the formation. As the heat sink migrates through the formation as illustrated in U.S. Pat. No. 5,217,076, through various bores and grids contained therein, the mobilization of oil to the producing bore results. The injection and production bores are oriented so that each mined room 88 has either two injection bores or two production bores. In either case the bores exiting the mined room 88 are spaced 1800. Each mined room 88 is placed a predetermined distance from a second mined room 88, this distance being dictated by of the geological formation. The mined room 88 containing injection bores is alternated with a mined room 88 containing a production bore. The mined rooms 88 alternate through the geological formation. In this way the formation is mobilized in a most efficient manner for recovery of oil.

It will be appreciated that the two phase heat generation system 10' produces enormous amounts of super heated steam and non-condensable inert gas.

It will be appreciated that the two phase, heat generation system 10' has the ability to deliver compounds and salts via the water supply in the form of vaporized super heated steam as the carrier. As the super heated steam condenses and cools, the compounds and salts are delivered and redissolved.

It will be appreciated that the two phase heat generation system 10' is highly efficient delivering 90 to 100% efficiency. The efficiency is enhanced by the lack of necessity, as compared to conventional methods, of cooling the compressed air in the final stage of compression. Compressed air is delivered into the combustion chamber at approximately 180° F., without the need for cooling, thereby saving energy.

It will be appreciated that the two phase heat generation system can be controlled alternatively by a central processor that will in addition automatically ignite the system.

It will be appreciated that the two phase heat generation system 10' will have multiple applications outside those depicted in U.S. Pat. No. 5,217,076.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A two phase heat generation system comprising:

a primary pressure vessel having an upper and lower plate portion;

at least one interior vessel contained within said primary vessel defining a water cavity;

at least one interior vessel contained within said primary pressure vessel defining a combustion chamber, said water cavity being in fluid communication with said combustion chamber;

a combustion burner contained within said combustion chamber for controlling combustion;

at least one port for delivery of gas and compressed air to said combustion chamber;

an ignition source for initiating combustion within the combustion chamber; and at least one outlet for delivery of two phase product from said combustion chamber.

2. The system of claim 1 wherein said water cavity comprises an annular region surrounding said combustion chamber.

3. The system of claim 1 wherein said two phase heat generation system further comprises a sleeve with said combustion chamber, said sleeve being spaced from said combustion burner such that a sub-combustion chamber is defined.

4. The system of claim 1 wherein said combustion burner contains perforations.

5. The system of claim 1 wherein said ignition source is a pilot burner.

6. The system of claim 1 wherein said two phase heat generation system further comprises a control system to regulate said heat generation system.

7. A two phase heat generation system comprising:

a primary pressure vessel;

a combustion chamber contained within said primary pressure vessel;

a water cavity contained within said primary pressure vessel for directing fluid, said water cavity being in fluid communication with said combustion chamber;

a perforated combustion burner contained within said combustion chamber for controlling combustion;

a sleeve spaced apart from said combustion burner such that a sub-combustion chamber is formed, said sub-combustion chamber being in communication with said combustion chamber;

an inlet in communication with said combustion burner for delivery of gas and compressed air;

a control and ignition source for regulating ignition, the flow of compressed a air, natural gas and water; and an outlet in communication with said combustion chamber for delivery of two phase product.

8. The system of claim 7 wherein said system is 90% to 100% efficient.

9. The system of claim 7 wherein said two phase product is super heated steam and inert gases.

10. The system of claim 7 wherein said two phase product can be delivered at various temperatures and pressures.

11. The system of claim 7 further comprising:

an injection/field assembly, said injection/field assembly being in communication with said system, said injection/field assembly having an outer well head;

an inner well head contained within said outer well head;

an injection tube connected to said inner well head and said outer well head;

a well tubing running the length of a bore, said well tubing connected to said outer well head;

a conductor pipe connected to said outer well head, said conductor pipe and said well tubing forming an annular space; and a collar pipe, said collar pipe being exterior to said annular space.

12. The system of claim 11 wherein a two phase product is injected through said injection/field assembly.

13. A method of creating an injection/field assembly system comprising the steps of:

providing a mined room;

providing a large diameter bore drilled from said mined room at an angle 1° to 10°;

providing a large diameter collar pipe placed and cemented in said large diameter bore;

providing a conductor bore drilled via a diverter placed on said collar pipe, a conductor pipe being set and centralized in said bore with a silica/cement;

providing a second diverter attached to said conductor pipe through which an injection/product bore is drilled and left uncased;

providing a well tubing within said uncased bore; and providing an injection tube in said well tubing for delivery of two phase product.

14. The method of claim 13 wherein said mined room contains two injection bores.

15. A method of claim 13 wherein said mined room contains two production bores.

16. The method of claim 13 wherein a plurality of said mined rooms are provided and spaced apart a predetermined distance.

17. The method of claim 13 wherein said two phase product is injected through said injection tubing, flowing through and out of said injection tubing and said uncased bore creating a heat sink.

18. A two phase heat generation system comprising:

a primary pressure vessel having a top and a bottom;

at least one interior vessel contained within said primary vessel defining a water cavity;

at least one interior vessel contained within said primary pressure vessel defining a combustion chamber, said water cavity being in fluid communication with said combustion chamber;

a combustion burner contained within said combustion chamber for controlling combustion;

at least one port for delivery of gas and compressed air to said combustion chamber;

at least one outlet for delivery of two phase product from said combustion chamber; and an ignition source for initiating combustion within the combustion chamber.

19. The system of claim 18 wherein said water cavity comprises an annular region surrounding said combustion chamber.

20. The system of claim 18 wherein said combustion burner contains perforations.

21. The system of claim 18 which said ignition source is a pilot burner.

22. The system of claim 18 wherein a control system regulates the system.

23. A two phase heat generation system comprising:

a primary pressure vessel;

a combustion chamber contained within said primary pressure vessel;

a water cavity contained within said primary pressure vessel for directing fluid, said water cavity being in fluid communication with said combustion chamber;

a perforated combustion burner and a perforated flame arrestor contained within said combustion chamber for controlling combustion;

an inlet in communication with said combustion burner for delivery of gas and compressed air;

an outlet in communication with said combustion chamber for delivery of two phase product; and a control and ignition source for regulating ignition, the flow of compressed air, natural gas and water.

24. The system of claim 23 wherein said system is 90% to 100% efficient.

25. The system of claim 23 wherein said two phase product is super heated steam and inert gases.

26. The system of claim 23 wherein said two phase product can be delivered at various temperatures and pressures.

27. The system of claim 23 further comprising:

an injection/field assembly, said injection/field assembly being in communication with said system, said injection/field assembly having an outer well head;

an inner well head contained within said outer well head;

an injection tube connected to said inner well head and said outer well head;

a well tubing running the length of a bore, said well tubing connected to said outer well head;

a conductor pipe connected to said outer well head, said conductor pipe and said well tubing forming an annular space; and a collar pipe, said collar pipe being exterior to said annular space.

28. A method of creating an injection/field assembly system comprising the steps of:

providing a mined room;

providing a large diameter bore drilled from said mined room at an angle 1° to 10°;

providing a large diameter collar pipe placed and cemented in said large diameter bore;

providing a conductor bore drilled via a diverter placed on said collar pipe, a conductor pipe being set and centralized in said bore with a silica/cement;

providing a second diverter attached to said conductor pipe through which an injection/product bore is drilled and left uncased;

providing a well tubing within said uncased bore; and providing an injection tube in said well tubing for delivery of two phase product.

29. The method of claim 28 wherein said mined room contains two injection bores.

30. A method of claim 28 wherein said mined room contains two production bores.

31. The method of claim 28 wherein said mined room is multiple in number and spaced a predetermined distance.

32. The method of claim 28 wherein said two phase product is injected through said injection tubing, flowing through and out of said injection tubing and said uncased bore creating a heat sink.

* * * * *

UNITED STATES PATENT AND TRADEMARK OFFICE

CERTIFICATE OF CORRECTION

PATENT NO. : 6,491,096 B1
DATED : December 10, 2002
INVENTOR(S) : John A. Masek

It is certified that error appears in the above-identified patent and that said Letters Patent is hereby corrected as shown below:

Title page,
Item [57], ABSTRACT,
Line 2, “an,” should be -- an --.
Line 5, “125” should be -- 126 --.
Lines 12-13, “delivering” should be -- delivery --.

Column 1,
Line 66, first occurrence, “to” should be -- of --.

Column 6,
Line 33, “outer-well” should be -- outer well --.

Column 7,
Line 39, “the-minimum” should be -- the minimum --.

Column 9,
Line 2, “in” should be -- it --.
Line 11, “1800” should be -- $180^{o}$ --.
Line 13, after “by” delete “of”.

Column 10,
Line 32, after “compressed” delete “a”.

Column 11,
Line 41, “which” should be -- wherein --.

Signed and Sealed this

Fifth Day of August, 2003

JAMES E. ROGAN
*Director of the United States Patent and Trademark Office*